US005423528A

United States Patent [19]

Teranishi et al.

[11] Patent Number: 5,423,528

[45] Date of Patent: Jun. 13, 1995

[54] PAPER FEEDING DEVICE

[75] Inventors: Katsuyuki Teranishi; Toshiyuki Nakamura; Naoki Nakashima, all of Osaka, Japan

[73] Assignee: Mita Industrial Co., Ltd., Osaka, Japan

[21] Appl. No.: 160,188

[22] Filed: Dec. 2, 1993

[30] Foreign Application Priority Data

Jan. 11, 1993 [JP] Japan ..... 5-002894

[51] Int. Cl.[6] ..... B65H 7/08

[52] U.S. Cl. ..... 271/111; 271/119; 271/258; 271/263

[58] Field of Search ..... 271/22, 110, 111, 119, 271/263; 427/258

[56] References Cited

U.S. PATENT DOCUMENTS 4,494,747 1/1985 Graef .
4,682,769 7/1987 Murakami ..... 271/119 X
5,069,438 12/1991 Urban ..... 271/119 X

*Primary Examiner*—H. Grant Skaggs

*Assistant Examiner*—Carol L. Druzbick

*Attorney, Agent, or Firm*—Beveridge, DeGrandi, Weilacher & Young

[57] ABSTRACT

A paper feeding device for taking out paper sheets contained in a paper containing section one at a time by a paper feeding roller to feed the paper sheets. When a paper jam occurs in the position of the paper feeding roller, the rotation in one direction of the paper feeding roller is continued, so that the paper feeding roller is returned to its home position. At the time when the paper feeding roller is returned to its home position, the rotation of the paper feeding roller is stopped, to prepare for paper jam processing. A nip portion which nips the paper sheet and a non-nip portion spaced apart from the paper sheet are located on an outer peripheral surface of the paper feeding roller. In the home position, the nip portion is not opposed to the paper sheet and the non-nip portion is opposed to the paper sheet. That is, when a paper jam occurs, the paper feeding roller is stopped in a state where it is not pressed against the paper sheet in the paper containing section.

10 Claims, 8 Drawing Sheets

PAPER FEEDING DEVICE

BACKGROUND OF THE INVENTION

1. Field of the Invention

The present invention relates to a paper feeding device provided for an image forming apparatus such as a copying machine or a printer.

2. Description of the Related Art

Conventionally, an image forming apparatus provided with an image forming section for forming an image on paper sheets, for example, a copying machine or a printer has been widely used. A paper containing section containing the paper sheets is attached to the main body of the image forming apparatus so that it can be pulled out. A paper feeding device for feeding the paper sheets in the paper containing section one at a time toward the image forming section is provided inside the main body of the image forming apparatus. The paper feeding device comprises a paper feeding roller for taking out the paper sheets in the paper containing section one at a time. A paper feeding roller which is approximately semicircular in cross section is most commonly used as the paper feeding roller.

The above described paper feeding device is so constructed that the driving of the paper feeding roller is forced to be stopped if a paper jam occurs in the position of the paper feeding roller. The occurrence of the paper jam is displayed on a display section so as to urge a user to perform paper jam processing. Consequently, the user recognizes that the paper jam occurs in the position of the paper feeding roller, to perform the paper jam processing. In this case, the paper jam processing is processing by pulling the paper containing section out of the main body of the image forming apparatus and removing the paper sheet which causes the paper jam to solve the paper jam state.

In the above described paper feeding device, however, the following problem arises if the paper jam occurs, after the paper feeding by the feeding roller has been started, in the position of the paper feeding roller in a state where a circular arc surface of the paper feeding roller nips the paper sheet in the paper containing section.

More specifically, if the paper feeding roller is stopped because the paper jam occurs in the above described state, the nip pressure of the paper feeding roller is applied to not only the paper sheet which causes the paper jam but also the paper sheets under the paper sheet, which have not been fed yet. In this state, if the paper containing section is pulled out of the main body of the image forming apparatus so as to perform the above described paper jam processing, not only the paper sheet which is jammed but also the paper sheets which have not been fed yet are wrinkled. Therefore, the wrinkled paper sheets which have not been fed yet must be taken out of the paper containing section and discarded. As a result, the paper jam processing becomes complicated, which takes long, and the paper sheets are wasted.

In order to deal with the above described problem, the applicant of the present application paid attention to the shape of the paper feeding roller. Specifically, the paper feeding roller which is approximately semicircular in cross section has a circular arc surface serving as a nip surface and a horizontal surface which does not nip a paper sheet. Accordingly, it is considered that when a paper jam occurs in the position of the paper feeding roller, paper sheets which have not been fed yet are not wrinkled at the time of paper jam processing if the rotation of the paper feeding roller is stopped not immediately but after returning the paper feeding roller to its home position where the nip surface is not opposed to the paper sheet and the horizontal surface is opposed to the paper sheet.

As a method of returning the paper feeding roller to the home position, a method of rotating the paper feeding roller in the reverse direction to return the paper feeding roller to the home position when the paper jam occurs in the position of the paper feeding roller is considered. In this method, however, a reversing mechanism for rotating the paper feeding roller in the reverse direction must be provided, although the paper sheets which have not been fed yet are not wrinkled at the time of the paper jam processing. Therefore, a mechanism for driving the paper feeding roller becomes complicated, and increased in size as well as manufacturing cost.

SUMMARY OF THE INVENTION

An object of the present invention is to provide a paper feeding device capable of performing good paper jam processing.

Another object of the present invention is to provide a paper feeding device capable of shortening time required for paper jam processing.

Still another object of the present invention is to provide a paper feeding device capable of performing good paper jam processing without excessively increasing the manufacturing cost.

An image forming apparatus, for example, is so constructed that the driving of a mechanism related to image formation is generally stopped even when a paper jam occurs in any portion. In this case, even if only a paper feeding roller is rotated in the forward direction when the paper jam occurs in the position of the paper feeding roller, the image forming apparatus is not particularly interfered with if the driving of the mechanism related to image formation in other portion is stopped.

In the present invention, therefore, when a paper jam occurs in the position of a paper feeding roller, the rotation in one direction of the paper feeding roller is continued, so that the paper feeding roller is returned to its home position. At the time when the paper feeding roller is returned to the home position, the rotation of the paper feeding roller is stopped, to prepare for paper jam processing. A nip portion which nips a paper sheet and a non-nip portion spaced apart from the paper sheet are formed on an outer peripheral surface of the paper feeding roller. In the home position, the nip portion of the paper feeding roller is not opposed to the paper sheet and the non-nip portion thereof is opposed to the paper sheet. That is, when the paper jam occurs, the paper feeding roller is stopped in a state where it is not pressed against the paper sheet in the paper containing section.

Even if no particular mechanism is provided, therefore, paper jam processing can be well performed. For example, when the paper containing section provided for the main body of the image forming apparatus so that it can be pulled out is pulled out, paper sheets which have not been fed yet are not wrinkled. Moreover, it is possible to shorten the time required for the paper jam processing.

If the paper jam thus occurs in the position of the paper feeding roller, the paper feeding roller is not immediately stopped as in the conventional example but stopped after it is returned to the home position. Consequently, the paper feeding roller is not stopped in a nip state where it is pressed against the paper sheet in the paper containing section. Even if the paper containing section is pulled out so as to perform the paper jam processing, therefore, the paper sheets which have not been fed yet in the paper containing section may not be wrinkled, thereby making it possible to shorten the time required for the paper jam processing.

The foregoing and other objects, features, aspects and advantages of the present invention will become more apparent from the following detailed description of the present invention when taken in conjunction with the accompanying drawings.

DESCRIPTION OF PREFERRED EMBODIMENTS

Figure 1:
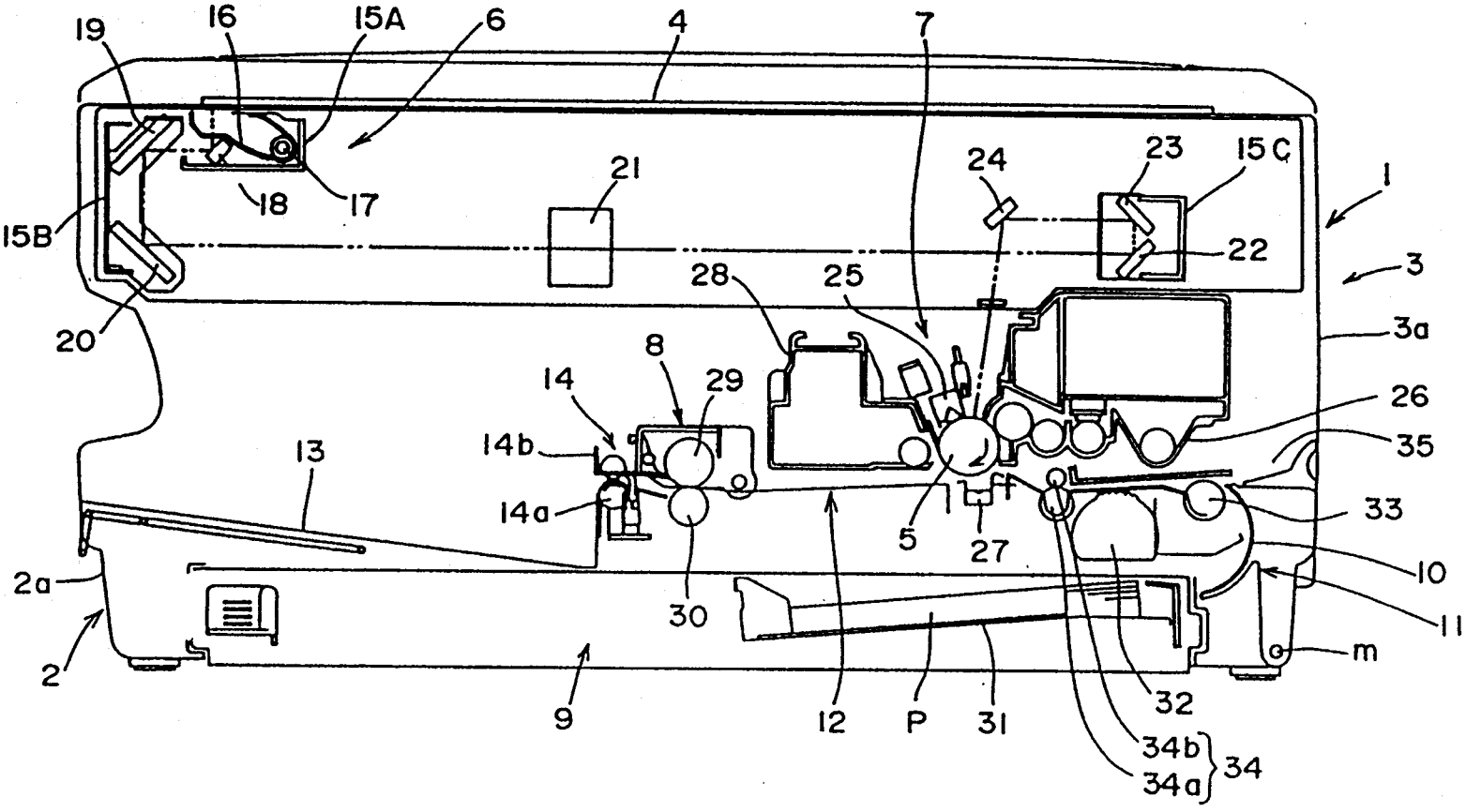
FIG. 1 is a schematic diagram showing the internal construction of a copying machine in which a paper feeding device according to one embodiment of the present invention is incorporated.

FIG. 1 is a schematic diagram showing the internal construction of a copying machine which is an image forming apparatus in which a paper feeding device according to one embodiment of the present invention is incorporated. The main body of the copying machine 1 is of a so-called clamshell type. Specifically, the main body of the copying machine 1 comprises a lower unit 2 sectioned by a lower casing 2*a* and an upper unit 3 sectioned by an upper casing 3*a*. The upper unit 3 is so supported as to be relatively rotatable around a horizontal axis m provided at an end of the lower unit 2.

An optical system 6 for illuminating and scanning a document put on a transparent platen 4 and introducing reflected light from the document into a photosensitive drum 5 to form an electrostatic latent image on the surface of the photosensitive drum 5 is provided inside the upper unit 3. On the other hand, there are provided inside the lower unit 2 an image forming section 7 for developing the electrostatic latent image formed on the photosensitive drum 5 into a toner image and transferring the toner image on paper sheets, a fixing section 8 for fixing the toner image on the paper sheets, a paper feeding section 11 for feeding the paper sheets contained in a paper containing section 9 into the image forming section 7 through a paper feeding guide 10, a conveying section 12 for conveying to the fixing section 8 the paper sheets on which the toner image is transferred, and a discharge section 14 for discharging to a paper discharge tray 13 the paper sheets on which the toner image is fixed.

The optical system 6 comprises a fluorescent lamp 17 with a reflecting plate 16 which is fixed to a first moving frame 15A. The document on the transparent platen 4 is illuminated and scanned by light from the fluorescent lamp 17. The reflected light from the document is introduced into the photosensitive drum 5 sequentially through a first mirror 18 fixed to the first moving frame 15A, a second mirror 19 and a third mirror 20 fixed to a second moving frame 15B, a lens 21, a fourth mirror 22 and a fifth mirror 23 fixed to a third moving frame 15C, and a sixth mirror 24.

The image forming section 7 comprises the photosensitive drum 5. A charging corona discharger 25, a developing device 26, a transferring corona discharger 27, and a cleaning device 28 are sequentially disposed in the direction of rotation of the photosensitive drum 5 around the photosensitive drum 5. The charging corona discharger 25 uniformly charges the surface of the photosensitive drum 5. A document image is formed on an outer peripheral surface of the charged photosensitive drum 5, thereby forming an electrostatic latent image. The electrostatic latent image is developed into a toner image by the developing device 26. The toner image is transferred to the paper sheets by the transferring corona discharger 27. The cleaning device 28 recovers toner particles remaining on the surface of the photosensitive drum 5 after the toner image is transferred.

The fixing device 8 comprises a heating roller 29 in which a heater lamp is mounted and a pressure roller 30 which is pressed against the heating roller 29 from below.

The paper containing section 9 is mounted on the lower unit 2 so that it can be pulled out and contains a paper feeding cassette 31.

The paper feeding section 11 comprises a paper feeding roller 32 for taking out paper sheets one at a time from the paper feeding cassette 31, a conveying roller 33 for feeding the paper sheet fed from the paper feeding cassette 31, and registration means 34 for causing the paper sheet conveyed by the conveying roller 33 to wait short of the photosensitive drum 5 and then, feeding the paper sheet to the photosensitive drum 5. The registration means 34 has a driving registration roller 34*a* and a driven registration roller 34*b*. The registration means 34 feeds the paper sheet to the photosensitive drum 5 at timing synchronized with the rotation of the photosensitive drum 5.

The conveying section 12 has a conventionally known structure comprising conveying means such as a conveying belt. In addition, the discharge section 14 comprises a driving paper discharge roller 14*a* and a driven paper discharge roller 14*b*.

Reference numeral 35 denotes a manual paper feeding section. A paper sheet manually fed from the manual paper feeding section 35 is conveyed to the registration means 34 by the conveying roller 33.

Description is made of copying operations of the above described copying machine. The photosensitive drum 5 is rotated at constant speed in a clockwise direction, as indicated by an arrow in FIG. 1. The surface of the photosensitive drum 5 is charged to a predetermined potential by the charging corona discharger 25 in the process of this rotation. An electrostatic latent image is formed on the surface of the photosensitive drum 5 by exposure made by the optical system 6. Toner particles are then supplied to the surface of the photosensitive drum 5, to develop the electrostatic latent image into a toner image by the developing device 26.

Paper sheets P in the paper feeding cassette 31 are fed to the photosensitive drum 5 by the paper feeding roller 32 in synchronism with the above described operations. At this time, the paper sheet P fed by the paper feeding roller 32 is caused to wait short of the photosensitive drum 5 by the registration rollers 34*a* and 34*b*. Thereafter, the registration rollers 34*a* and 34*b* are driven at timing synchronized with the rotation of the photosensitive drum 5, so that the paper sheet P is fed to the photosensitive drum 5. Consequently, the toner image on the photosensitive drum 5 is transferred to the paper sheet P by the transferring corona discharger 27. The paper sheet P on which the toner image is transferred is conveyed to the fixing section 8 by the conveying section 12. In the fixing section 8, the transferred image is fixed by the heating roller 29 and the pressure roller 30. Thereafter, the paper sheet P on which the transferred image is fixed is discharged onto the paper discharge tray 13 by the paper discharge rollers 14*a* and 14*b*. The toner particles remaining on the surface of the photosensitive drum 5 are removed by the cleaning device 28.

Figure 2:
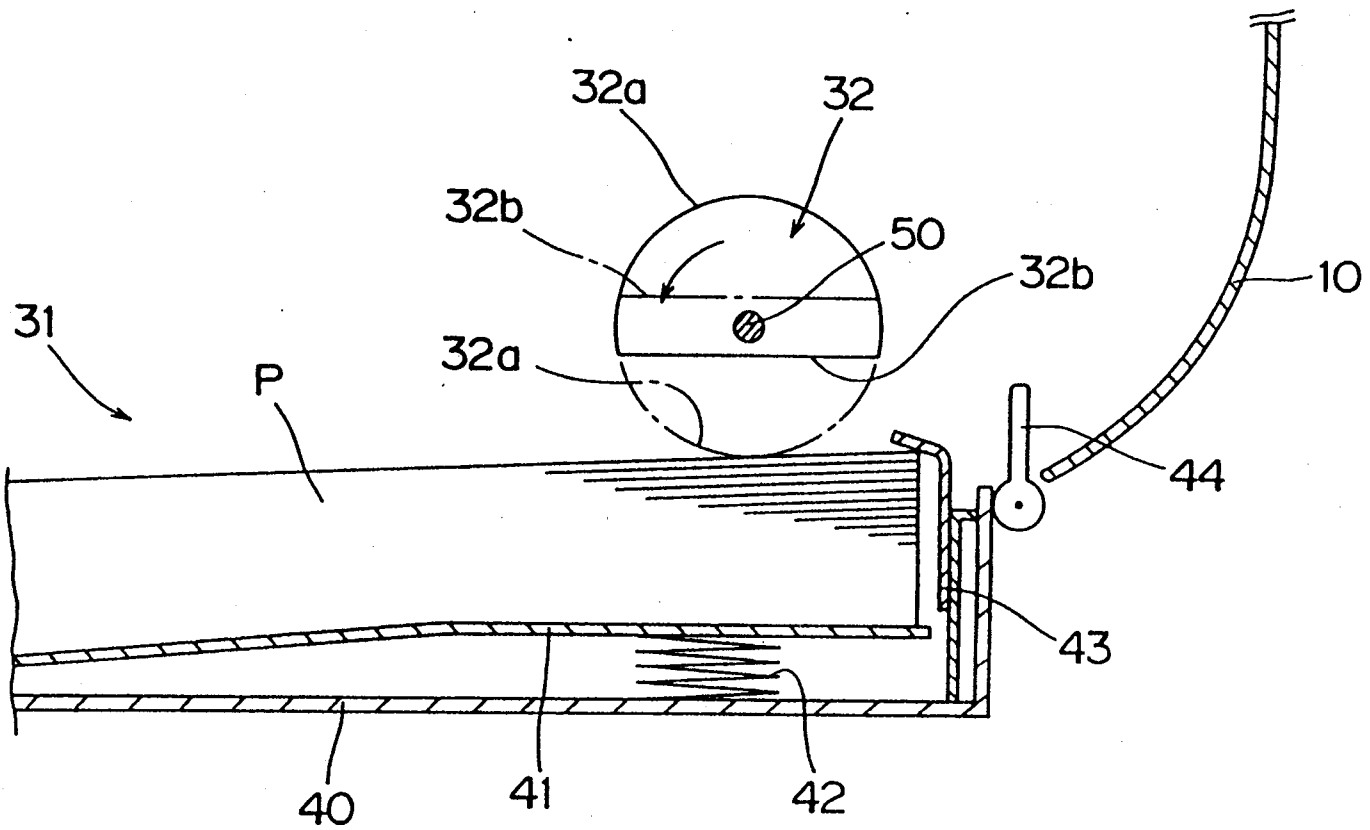
FIG. 2 is a schematic diagram showing the internal construction of a paper feeding cassette and a paper jam detecting mechanism.

FIG. 2 is a schematic diagram showing the construction of sections related to the paper feeding roller 32. Referring to FIG. 2, description is made of the internal construction of the paper feeding cassette 31, a paper jam detecting mechanism, and the like.

The paper feeding roller 32 is one which is approximately semicircular in cross section perpendicular to a roller shaft 50. A circular arc surface 32*a* serving as a nip portion which is brought into contact with the paper sheet P in the paper feeding cassette 31 and a horizontal surface 32*b* serving as a non-nip portion so formed as not to be brought into contact with the paper sheet P in the paper feeding cassette 31 are formed on the outer peripheral surface of the paper feeding roller 32.

The paper feeding cassette 31 is disposed below the paper feeding roller 32. The paper feeding cassette 31 comprises a cassette body 40 whose upper surface is opened, a swing plate 41 on which the paper sheets P are put, a compression coil spring 42 interposed between a lower surface of the swing plate 41 and an inner bottom surface of the cassette body 40, and a regulating claw 43 provided on a front inner wall of the cassette body 40. The swing plate 41 is provided so as to be swingable up and down in the cassette body 40. The swing plate 41 is urged upward by the coil spring 42. Consequently, the paper sheet P is pressed against the paper feeding roller 32. The regulating claw 43 regulates upward displacement of the front ends of the paper sheets P and prevents the paper sheets other than the paper sheet put uppermost from being fed at the time of driving the paper feeding roller 32.

The paper sheets P in the paper feeding cassette 31 are fed one at a time toward the photosensitive drum 5 through the paper feeding guide 10 by the paper feeding roller 32 in the following manner. Specifically, before the driving, the paper feeding roller 32 is in its home position where the circular arc surface 32*a* serving as a nip portion is directed upward and the horizontal surface 32*b* which does not nip the paper sheet is directed downward, as indicated by a solid line in FIG. 2. That is, when the position for rotation of the paper feeding roller 32 is the home position, the circular arc surface 32*a* is not opposed to the paper sheet P and the horizontal surface 32*b* is opposed to the paper sheet P.

If the paper feeding roller 32 is rotated in a counterclockwise direction around the roller shaft 50, the circular arc surface 32*a* of the paper feeding roller 32 is pressed against the uppermost paper sheet in the paper feeding cassette 31, as indicated by a one-dot and dash line in FIG. 2. The front end of the uppermost paper sheet is flexed by the nip pressure of the paper feeding roller 32, to be released from the regulation of the regulating claw 43. As a result, the uppermost paper sheet is pulled out of the paper feeding cassette 31.

Furthermore, a paper detecting switch 44 for detecting the paper sheet P pulled out of the paper feeding cassette 31 by the paper feeding roller 32 is provided between a front end of the paper feeding cassette 31 and a rear end of the paper feeding guide 10. The paper detecting switch 44 comprises a lever which is inclined by abutting on the front end of the paper sheet P fed by the paper feeding roller 32 and is retuned to its original position at the time when the rear end of the paper sheet P has passed. The paper detecting switch 44 is turned on by inclining the lever, while being turned off by returning the lever to its initial position. The switching between the on and off states of the paper detecting switch 44 is monitored, thereby making it possible to know whether the paper sheet P is normally fed or the paper sheet P is jammed in the position of the paper feeding roller 32.

Figure 3:
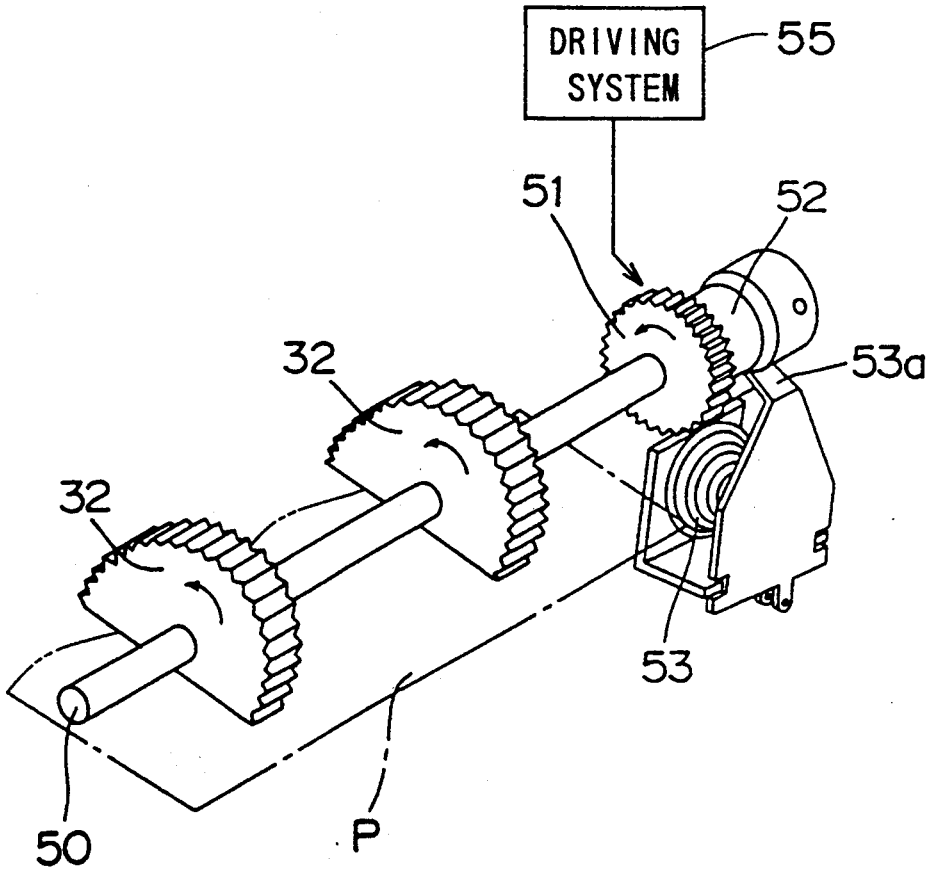
FIG. 3 is a perspective view showing a mechanism for driving a paper feeding roller.

FIG. 3 is a perspective view showing a mechanism for driving the paper feeding roller 32. The paper feeding roller 32 comprises a plurality of axially spaced rollers fixed to the roller shaft 50. The mechanism for driving the paper feeding roller 32 comprises the above described roller shaft 50 for supporting the paper feeding roller 32 so as to be integrally rotatable, a driving gear member 51 supported on the roller shaft 50 so as to be rotatable, and a spring clutch 52. The driving gear member 51 is driven to be rotated in one direction upon receipt of torque from a driving system 55. The spring clutch 52 is used for selectively transmitting a driving force of the driving gear member 51 to the roller shaft 50. The spring clutch 52 is switched by solenoid 53 between the connected state where the driving force of the driving gear member 51 is transmitted to the roller shaft 50 and the disconnected state where the driving force of the driving gear member 51 is not transmitted to the roller shaft 50.

The spring clutch 52 has a conventionally known structure comprising a driven member which is provided so as to be rotatable relative to the driving gear member 51 and is rotated integrally with the roller shaft 50, a coil spring which is stretched between predetermined portions of the driven member and the driving gear member 51 and has its end fixed to the driven member, a sleeve to which the other end of the coil spring is fixed and which is fitted so as to cover the coil spring, and an engaging projection which is provided in a predetermined position of an outer peripheral surface of the sleeve. The coil spring is wound in such a direction as to be reduced in diameter as the driving gear member 51 is rotated.

The solenoid 53 comprises an engaging claw 53*a* which is engaged with the engaging projection in the spring clutch 52. If an excitation signal is inputted, the solenoid 53 disengages the engaging claw 53*a* from the engaging projection in the spring clutch 52. On the other hand, if a demagnetization signal is inputted, the solenoid 53 switches the engaging claw 53*a* into its position for engagement. When the engaging claw 53*a* is engaged with the engaging projection in the spring clutch 52, the rotation of the sleeve is prevented, so that the coil spring remains increased in diameter. If the engaging claw 53*a* is disengaged from the engaging projection in the spring clutch 52, the rotation of the sleeve is allowed. Consequently, the rotation of the driving gear member 51 is provided to the coil spring, so that the coil spring is reduced in diameter. Therefore, the driving force of the driving gear member 51 is transmitted to the driven member, so that the roller shaft 50 is rotated in one direction.

If the engaging claw 53*a* is disengaged from the engaging projection in the spring clutch 52 by the input of the demagnetization signal to the solenoid 53, the coil spring in the spring clutch 52 is reduced in diameter with the disengagement. Consequently, the paper feeding roller 32 is rotated upon receipt of the driving force of the driving gear member 51. Accordingly, the paper sheet P in the paper feeding cassette is fed by the paper feeding roller 32. Thereafter, if the demagnetization signal is inputted to the solenoid 53 at predetermined timing before the paper feeding roller 32 is rotated once, the engaging claw 53*a* is restored to its original position. At the time when the paper feeding roller 32 is rotated once, therefore, the engaging claw 53*a* is engaged again with the engaging projection in the spring clutch 52. Consequently, the rotation of the sleeve in the spring clutch 52 is stopped. The coil spring in the spring clutch 52 is increased in diameter with the rotation. Consequently, the driving force of the driving gear member 51 is not transmitted, so that the rotation of the paper feeding roller 32 is stopped. That is, the paper feeding roller 32 is stopped in the home position.

Figure 4:
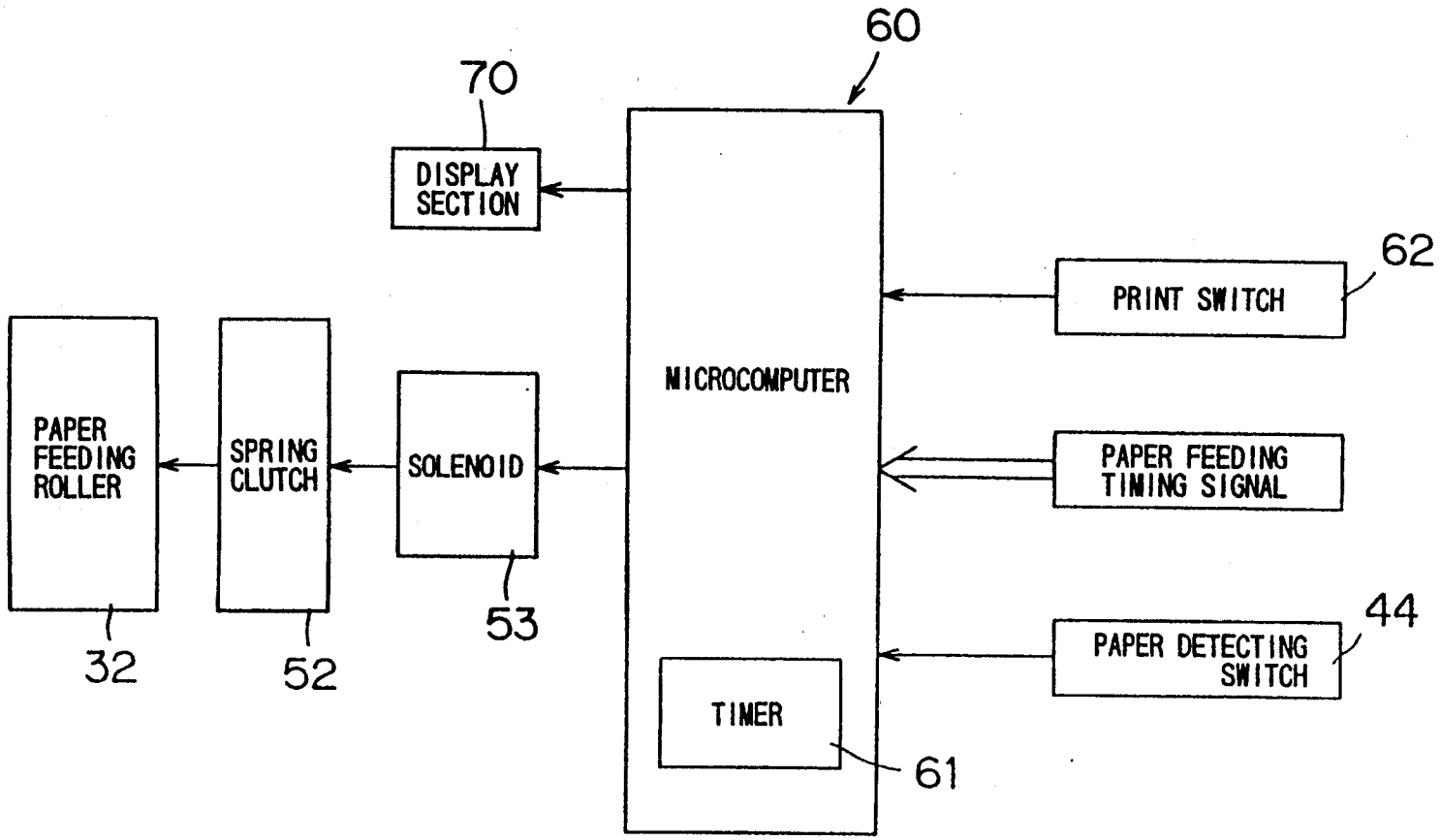
FIG. 4 is a block diagram showing the electrical construction of a control circuit for controlling the feeding of paper sheets.

FIG. 4 is a block diagram showing the electrical construction of a control circuit for controlling the paper feeding section 11. This control circuit comprises a microcomputer 60. The microcomputer 60 comprises a CPU (Central Processing Unit), a data RAM (Random Access Memory), a program ROM (Read-Only Memory), and the like, and carries out control in accordance with a program previously stored in the ROM. The microcomputer 60 contains a timer 61 for counting, for example, predetermined roller rotating time T required until the paper feeding roller 32 is rotated once to be returned to the home position.

An operation signal from a print switch 62, a detecting signal from a paper detecting switch 44, and a paper feeding timing signal are applied to the microcomputer 60. The microcomputer 60 excites (turns on)/demagnetizes (turns off) the solenoid 53 on the basis of the respective signals. Consequently, the spring clutch 52 is switched between the engaged state and the disengaged state, so that the driving of the paper feeding roller 32 is controlled. A display section 70 is further connected to the microcomputer. When a paper jam occurs, the display section 70 displays the fact that the paper jam occurs and a portion where the paper jam occurs.

Figure 5:
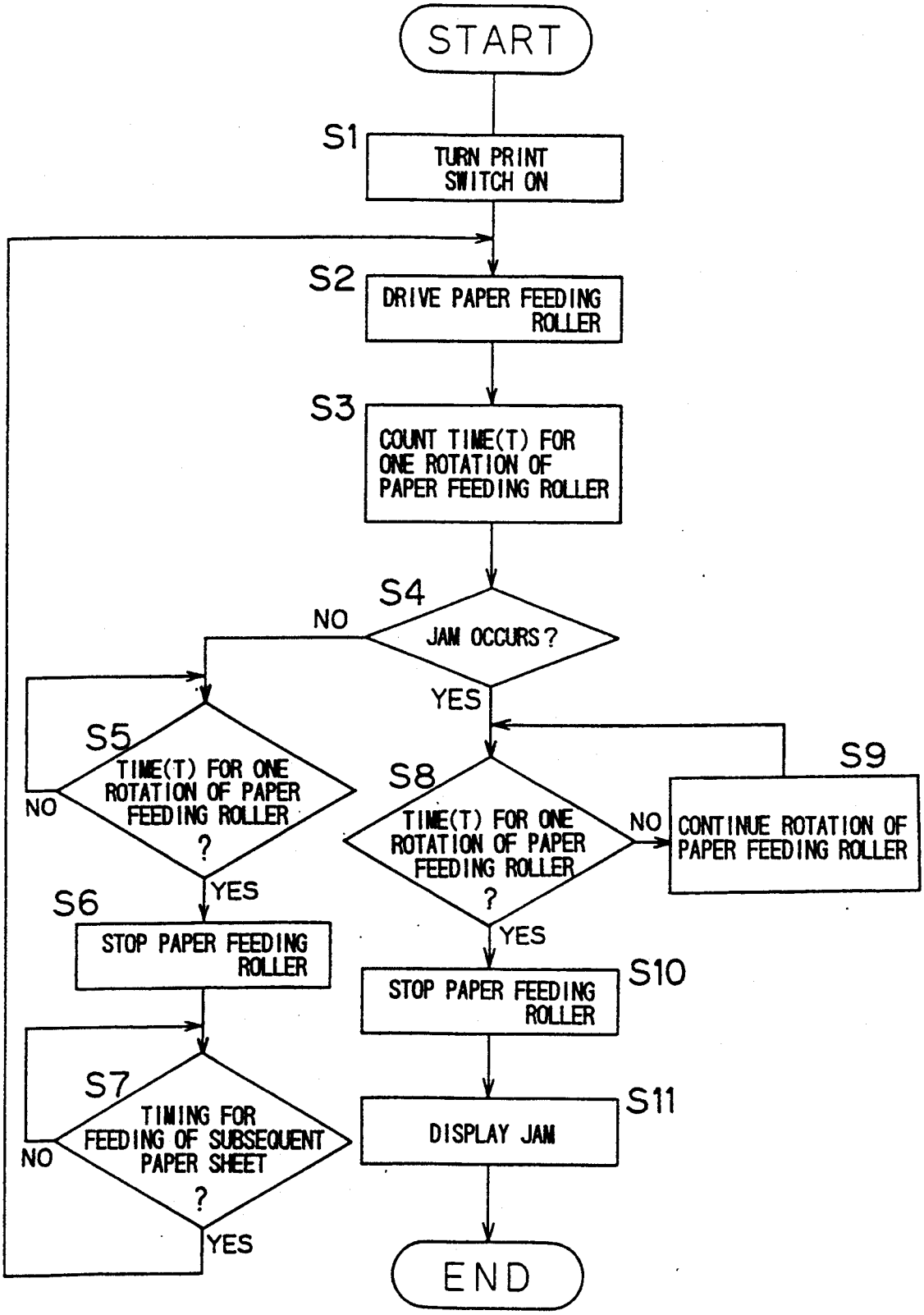
FIG. 5 is a flow chart showing paper feeding operations.
Figure 6:
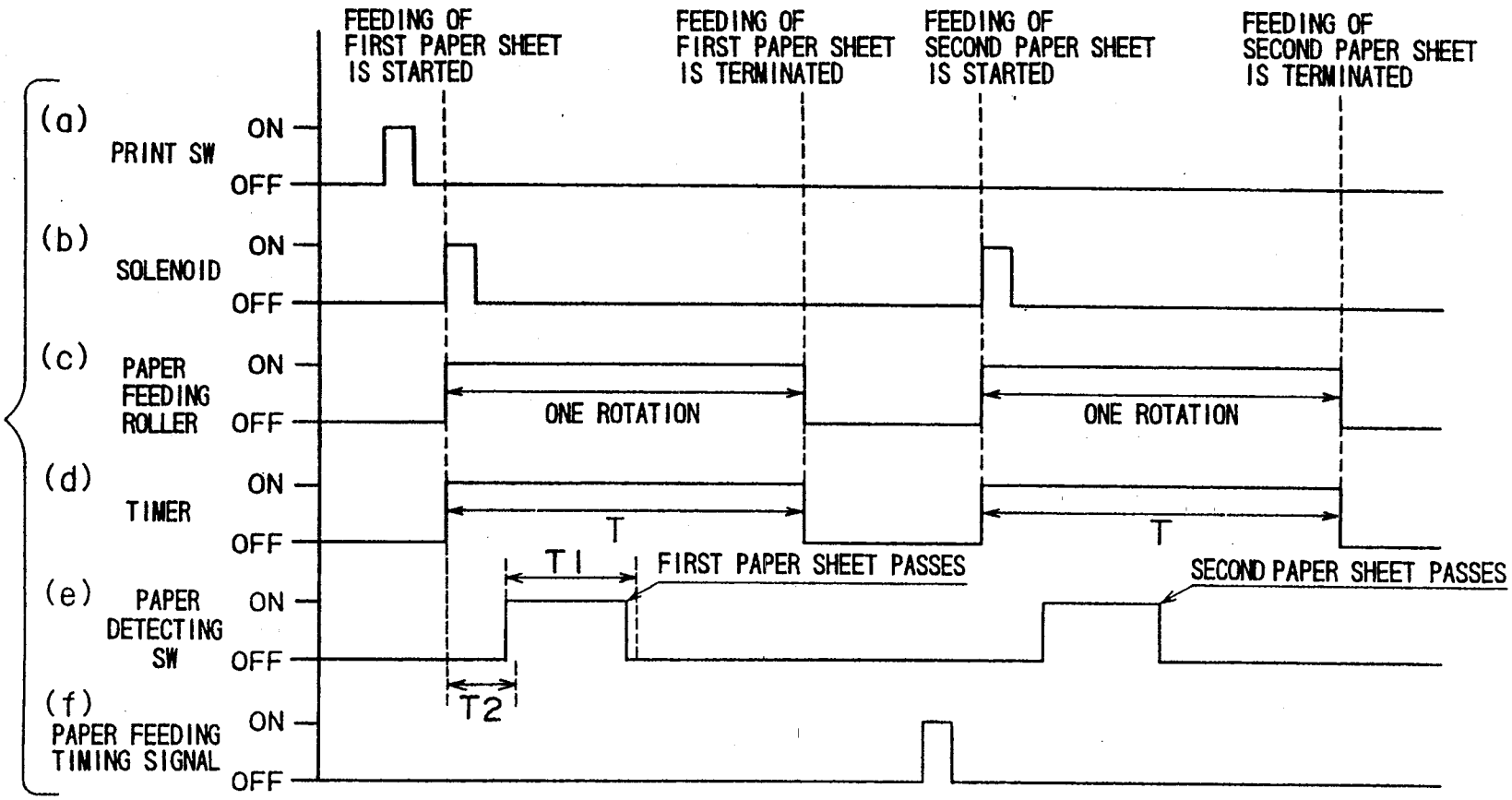
FIG. 6 is a timing chart showing a case where paper sheets are normally fed.
Figure 7:
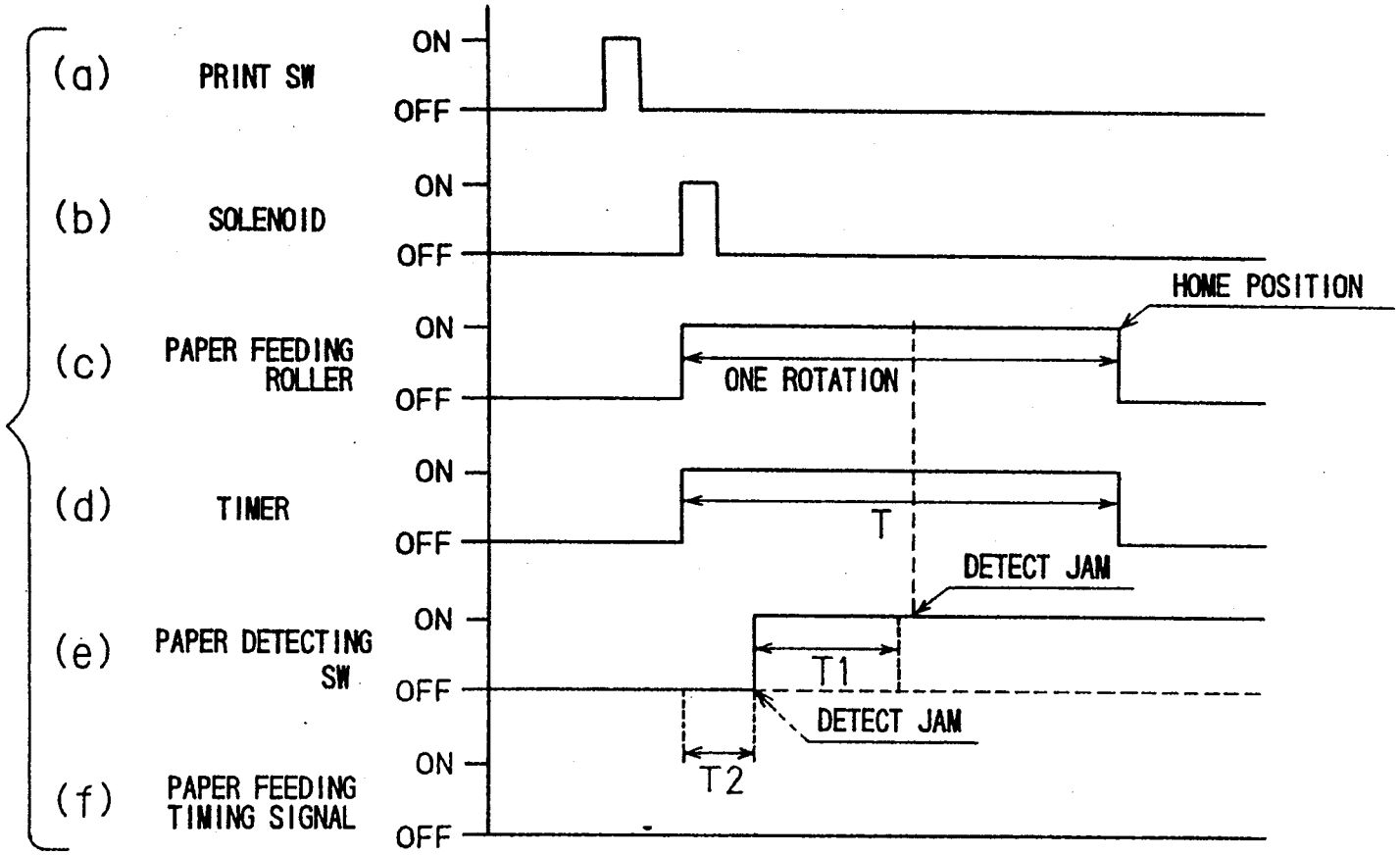
FIGS. 7 is a timing chart showing a case where a paper jam occurs.

FIG. 5 is a flow chart showing the flow of paper feeding operations of the paper feeding section. In addition, FIG. 6 is a timing chart showing operations in a case where paper sheets are normally fed, and FIG. 7 is a timing chart showing operations in a case where a paper jam occurs. In FIGS. 6 and 7, (a) shows print switch operation signal, (b) in FIGS. 6 and 7; shows the on and off states of the solenoid 53, and (c) in FIGS. 6 and 7 shows the rotation and the stop of the paper feeding roller 32. In addition, (d) in FIGS. 6 and 7 shows the counting operation of the timer 61, in FIGS. 6 and 7 shows the state of the paper detecting switch 44, and (f) in FIGS. 6 and 7 shows a paper feeding timing signal.

Referring now to FIG. 5 and FIG. 6, description is made of operations in a case where paper sheets are normally fed. When the print switch 62 is operated in the step S1 after the copying machine is started, the paper feeding roller 32 is driven to be rotated in the step S2. In the step S3, the timer 61 starts to count a predetermined time T required until the paper feeding roller 32 is rotated once to be returned to the home position. Specifically, as shown in (a), (b) and (c) of FIG. 6, if the print switch operation signal is inputted, the solenoid 53 is turned on. Consequently, the spring clutch 52 enters the connected state where the driving force of the driving gear member 51 is transmitted to the paper feeding roller 32. At this time, the timer 61 starts to count time, as shown in (d) of FIG. 6. The solenoid 53 is turned off at predetermined time before the paper feeding roller 32 is rotated once.

It is judged in the step S4 whether or not a paper jam occurs in the position of the paper feeding roller 32. It is examined by referring to an output of the paper detecting switch 44 (see FIG. 2) whether or not a paper jam occurs. Specifically, as shown in (e) of FIG. 6, if the paper detecting switch 44 is switched from the off state to the on state within a predetermined time period T2 elapsed since the feeding of the paper sheet by the paper feeding roller 32 was started, and the paper detecting switch 44 is switched from the on state to the off state before a predetermined time period T1 has elapsed since the switching, it is judged that the paper sheet in the paper feeding cassette 31 is normally fed toward the photosensitive drum 5. That is, it is judged that the paper sheet is not jammed.

When it is judged in the step S4 that the paper sheet is not jammed, the program proceeds to the steps S5 and S6. At the time when the timer 61 reaches the full count, the rotation of the paper feeding roller 32 is stopped. As a result, the feeding of the first paper sheet is terminated. Specifically, as shown in (c) and (d) of FIG. 6, the paper feeding roller 32 is stopped at the time when the timer 61 counts the above described predetermined roller rotating time T. That is, at the time when the paper feeding roller 32 is rotated once to be returned to the home position where the circular arc surface 32*a* serving as a nip portion is directed upward and the horizontal surface 32*b* which does not nip the paper sheet is directed downward (indicated by the solid line in FIG. 2), the paper feeding roller 32 is stopped.

Thereafter, it is judged in the step 67 that timing is timing at which the second paper sheet is to be fed, the operations in the step 62 and the subsequent steps are repeated. Specifically, as shown in (f) of FIG. 6, if the subsequent paper feeding timing signal is inputted with, for example, the rotation of the photosensitive drum 5, the solenoid 53 is turned on and the paper feeding roller 32 is driven to be rotated, as shown in (b) and (c) of FIG. 6. Consequently, the feeding of the second paper sheet is started. Thereafter, the same operations as those in the case of the feeding of the first paper sheet are performed.

Referring now to FIGS. 5 and 7 description is made of a case where a paper jam occurs in the position of the paper feeding roller 32. If it is judged in the step S4 that a paper jam occurs in the position of the paper feeding roller 32, the program proceeds to the steps S8, S9 and S10. In these steps, the rotation of the paper feeding roller 32 is continued until the timer 61 counts the above described predetermined roller rotating time T after the paper jam occurs. At the time when the timer 61 has counted the above described roller rotating time T, the paper feeding roller 32 is stopped. Thereafter, in the step S11, the fact that the paper jam occurs in the position of the paper feeding roller 32 is displayed on the display section 70, to urge a user to perform paper jam processing.

Specifically, as indicated by a dotted line in (e) of FIG. 7, when the paper detecting switch 44 is not switched from the off state to the on state, that is, remains in the off state before the above described predetermined time period T2 has elapsed since the feeding of the paper sheet by the paper feeding roller 32 was started, it is judged that a paper jam occurs between the paper feeding roller 32 and the regulating claw 43 in the paper feeding cassette 31. On the other hand, as indicated by a solid line in (e) of FIG. 7, even when the paper detecting switch 44 is switched from the off state to the on state within the above described predetermined time period T2 elapsed since the feeding of the paper sheet by the paper feeding roller 32 was started, the paper detecting switch 44 is not switched from the on state to the off state before the above described predetermined time period T1 has elapsed since the switching to detect the presence of the paper sheet, it is judged that a paper jam occurs in any position from the paper feeding roller 32 to the paper feeding path 10. That is, when the paper sheet cannot pass through the position of the paper detecting switch 44 within the time period T1, it is judged that a paper jam occurs.

In this case, as shown in (c) and (d) of FIG. 7, the rotation of the paper feeding roller 32 is continued until the timer 61 counts the above described predetermined roller rotating time T. At the time when the time 61 has counted the above described predetermined roller rotating time T, that is, the paper feeding roller 32 is rotated once to be returned to the home position where the circular arc surface **32*a* serving as a nip portion is directed upward and the horizontal surface 32*b* which does not nip the paper sheet is directed downward (indicated by the solid line in FIG. 2), the paper feeding roller 32** is stopped.

As described in the foregoing, in the present embodiment, if a paper jam occurs in the position of the paper feeding roller 32, the paper feeding roller 32 is not immediately stopped as in the conventional example but continues to be rotated until it is returned to the above described home position. Consequently, the rotation of the paper feeding roller 32 is not stopped in a nip state where the circular arc surface **32*a* serving as a nip surface of the paper feeding roller 32 is pressed against the paper sheet in the paper feeding cassette 31 (indicated by the one-dot and dash line in FIG. 2). Even if the paper feeding cassette 31 is pulled out so as to perform paper jam processing, therefore, the paper sheets which have not been fed yet in the paper feeding cassette 31** may not be wrinkled. Accordingly, the paper jam processing becomes simple, thereby making it possible to shorten the time required for the paper jam processing. In addition, the paper sheets which have not been fed yet are not uselessly wasted.

Although description was made of the embodiment of the present invention, the present invention is not limited to the above described embodiment. For example, although in the above described embodiment, the timer 61 is used as means for determining that the paper feeding roller 32 is returned to the home position, a structure for determining that the position for rotation of the paper feeding roller is the home position by mechanical means such as a micro switch may be employed.

Figure 8:
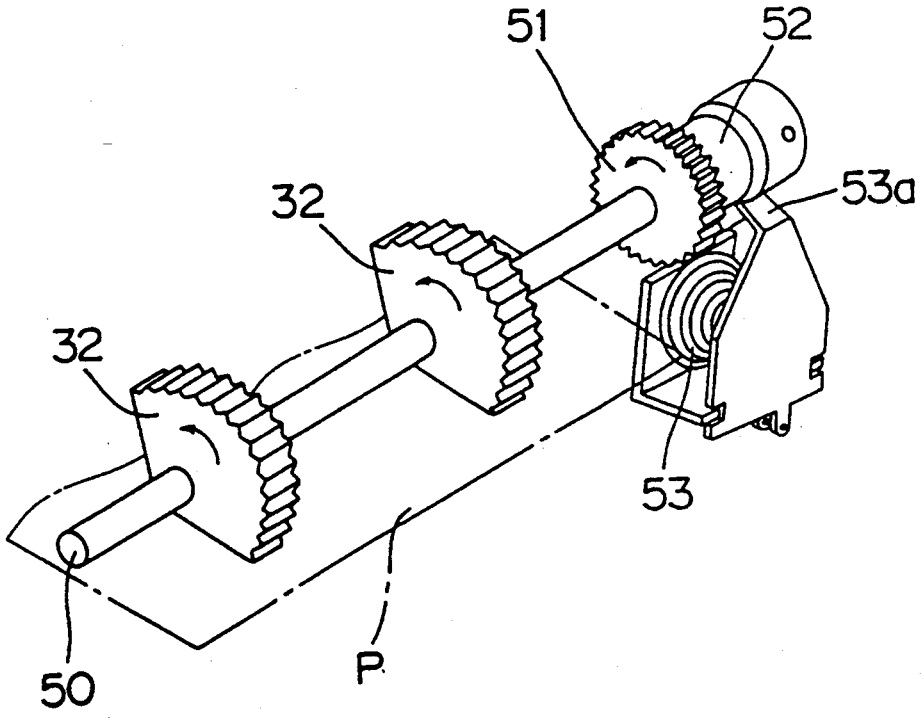
FIG. 8 is a perspective view showing an example of another construction of a paper feeding roller.

Furthermore, although in the above described embodiment, the paper feeding roller 32 which is approximately semicircular in cross section is used, a paper feeding roller 32A which is in a fan shape in cross section as shown in FIG. 8 may be used. In addition thereto, a paper feeding roller in an arbitrary shape capable of selectively opposing a nip portion which can be pressed against a paper sheet in a paper containing section and a non-nip portion which is not brought into contact with the paper sheet to the paper sheet by the rotation is applicable as the paper feeding roller.

Although the present invention has been described and illustrated in detail, it is clearly understood that the same is by way of illustration and example only and is not to be taken by way of limitation, the spirit and scope of the present invention being limited only by the terms of the appended claims.

The disclosure of Japanese Patent Application Serial No. 2894/1993, filed on Jan. 11, 1993, is incorporated herein by reference.

What is claimed is:

1. A paper feeding device for taking out, one at a time, paper sheets contained in a paper containing section to feed the paper sheets, said feeding device comprising:

a paper feeding roller disposed so as to be opposed to a paper sheet in the paper containing section, said paper feeding roller having, on an outer peripheral surface thereof, a nip portion which is brought into contact with a paper sheet for feeding the paper sheet and a non-nip portion which is not brought into contact with the paper sheet, said paper feeding roller being capable of selectively placing said nip portion and said non-nip portion in opposition to a paper sheet by rotation;

driving means for driving said paper feeding roller to rotate said paper feeding roller in one direction;

paper jam determining means for determining whether a paper jam has occurred in a position in the vicinity of said paper feeding roller;

rotation position determining means for determining whether said paper feeding roller has returned to a predetermined home position where said nip portion is not in opposition to a paper sheet in the paper containing section and said non-nip portion is in opposition to such paper sheet in the paper containing section; and control means for causing said driving means to rotate said paper feeding roller until said rotation position determining means determines that said paper feeding roller has returned to said home position when said paper jam determining means determines that a paper jam has occurred in the vicinity said paper feeding roller, and for causing said driving means to stop rotation of said paper feeding roller at a time when said paper feeding roller returns to said home position; wherein said paper jam determining means includes paper position determining means for determining whether or not a paper sheet taken out of the paper containing section by said paper feeding roller has reached a predetermined position in the vicinity of said paper feeding roller, and judging means for judging whether a paper jam has occurred in the vicinity of said paper feeding roller based on whether said paper position determining means determines that said paper sheet has not reached said predetermined position before expiration of a predetermined time period after said paper feeding roller has started feeding of such paper sheet.

2. A paper feeding device according to claim 1, wherein said paper feeding roller is approximately semicircular in a cross sectional plane which intersects its rotation axis and wherein said roller has a circular arc portion and a flat portion on its outer peripheral surface, said circular arc portion being said nip portion, and said flat portion being said non-nip portion.

3. A paper feeding device according to claim 1, wherein said paper feeding device is provided for an image forming apparatus having an image forming section for forming an image on a paper sheet and said paper containing section, said feeding device introducing a paper sheet from said paper containing section to said image forming section.

4. A paper feeding device according to claim 3, wherein said paper containing section is mounted on a main body of said image forming apparatus so that it can be pulled out.

5. A paper feeding device according to claim 1, further comprising means for pressing a paper sheet in the paper containing section against said nip portion of said paper feeding roller.

6. A paper feeding device for taking out, one at a time, paper sheets contained in a paper containing section to feed the paper sheets, said feeding device comprising:

a paper feeding roller disposed so as to be opposed to a paper sheet in the paper containing section, said paper feeding roller having, on an outer peripheral surface thereof, a nip portion which is brought into contact with a paper sheet for feeding the paper sheet, and a non-nip portion which is not brought into contact with the paper sheet, said paper feeding roller being capable of selectively placing said nip portion and said non-nip portion in opposition to a paper sheet by rotation;

driving means for driving said paper feeding roller to rotate said paper feeding roller in one direction;

paper jam determining means for determining whether a paper jam has occurred in a position in the vicinity of said paper feeding roller;

rotation position determining means for determining whether said paper feeding roller has returned to a predetermined home position where said nip portion is not in opposition to a paper sheet in the paper containing section and said non-nip portion is in opposition to such paper sheet in the paper containing section; and control means for causing said driving means to rotate said paper feeding roller until said rotation position determining means determines that said paper feeding roller has returned to said home position when said paper jam determining means determines that a paper jam has occurred in the vicinity of said paper feeding roller, and for causing said driving means to stop rotation of said paper feeding roller at a time when said paper feeding roller returns to said home position; wherein said paper jam determining means includes paper pass determining means for determining whether a paper sheet taken out of the paper containing section by said paper feeding roller passes through a predetermined position in the vicinity of said paper feeding roller, and judging means for judging whether a paper jam has occurred in the vicinity of said paper feeding roller based on whether said paper pass determining means has determined that a paper sheet has not passed through said predetermined position before expiration of a predetermined time period after such paper sheet has reached said predetermined position.

7. A paper feeding device according to claim 6, wherein said paper feeding roller is approximately semicircular in a cross sectional plane which intersects its rotation axis and wherein said roller has a circular arc portion and a flat portion on its outer peripheral surface, said circular arc portion being said nip portion, and said flat portion being said non-nip portion.

8. A paper feeding device according to claim 6, wherein said paper feeding device is provided for an image forming apparatus having an image forming section for forming an image on a paper sheet and said paper containing section, said feeding device introducing a paper sheet from said paper containing section to said image forming section.

9. A paper feeding device according to claim 8, wherein said paper containing section is mounted on a main body of said image forming apparatus so that it can be pulled out.

10. A paper feeding device according to claim 6, further comprising means for pressing a paper sheet in the paper containing section against said nip portion of said paper feeding roller.

* * * * *